US011323803B2

(12) United States Patent
Matsuda et al.

(10) Patent No.: US 11,323,803 B2
(45) Date of Patent: May 3, 2022

(54) EARPHONE, EARPHONE SYSTEM, AND METHOD IN EARPHONE SYSTEM

(71) Applicant: Sony Corporation, Tokyo (JP)

(72) Inventors: Shigeto Matsuda, Tokyo (JP); Yu Miyajima, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/969,983

(22) PCT Filed: Feb. 7, 2019

(86) PCT No.: PCT/JP2019/004474
§ 371 (c)(1),
(2) Date: Aug. 14, 2020

(87) PCT Pub. No.: WO2019/163538
PCT Pub. Date: Aug. 29, 2019

(65) Prior Publication Data

US 2020/0404417 A1 Dec. 24, 2020

(30) Foreign Application Priority Data

Feb. 23, 2018 (JP) ..... JP2018-030327

(51) Int. Cl.
*H04R 3/00* (2006.01)
*H04R 1/10* (2006.01)
*H04R 1/40* (2006.01)

(52) U.S. Cl.
CPC ..... *H04R 3/005* (2013.01); *H04R 1/10* (2013.01); *H04R 1/40* (2013.01); *H04R 2203/12* (2013.01); *H04R 2420/07* (2013.01)

(58) Field of Classification Search
CPC . H04R 3/005; H04R 1/10; H04R 1/40; H04R 2203/12; H04R 2420/07; H04R 25/55; H04R 25/552; H04R 5/033
(Continued)

(56) References Cited

U.S. PATENT DOCUMENTS 9,864,778 B1 * 1/2018 Strand ..... H04L 67/306
2011/0075858 A1 3/2011 Chihara et al.
(Continued)

FOREIGN PATENT DOCUMENTS

CN 204652616 U 9/2015
CN 106209130 A 12/2016
(Continued)

OTHER PUBLICATIONS

International Search Report and Written Opinion dated Apr. 16, 2019 for PCT/JP2019/004474 filed on Feb. 7, 2019, 9 pages including English Translation of the International Search Report.

*Primary Examiner* — William A Jerez Lora
(74) *Attorney, Agent, or Firm* — Xsensus LLP

(57) ABSTRACT

To further improve the quality of sound acquired by an ear head.

An earphone according to the present disclosure is an earphone that is one of earphones configuring an ear headset, the earphone including a sound acquisition unit configured to acquire sound data, a communication unit configured to receive sound data from the other earphone by wireless communication, and a sound quality improvement processing unit configured to perform processing of improving sound quality of the sound data acquired by the sound acquisition unit and the sound data received from the other earphone. With the configuration, the quality of a sound acquired by the ear head can be further improved.

13 Claims, 2 Drawing Sheets

(58) Field of Classification Search
USPC ..... 381/92, 124, 311, 315, 331
See application file for complete search history.

(56) References Cited

U.S. PATENT DOCUMENTS

| | | | | |
|---|---|---|---|---|
| 2012/0008807 | A1 | 1/2012 | Gran | |
| 2014/0093093 | A1 | 4/2014 | Dusan | |
| 2015/0092952 | A1 | 4/2015 | Sudo et al. | |
| 2016/0080868 | A1* | 3/2016 | Hensen | H04R 5/033 381/311 |
| 2016/0182991 | A1 | 6/2016 | Zakzeski | |
| 2016/0182997 | A1* | 6/2016 | Wilson | H04R 1/406 381/92 |
| 2016/0330541 | A1* | 11/2016 | Miao | H04R 1/1041 |
| 2017/0352360 | A1* | 12/2017 | Thoen | G10L 21/02 |
| 2018/0220004 | A1* | 8/2018 | Onizuka | H04L 12/1827 |

FOREIGN PATENT DOCUMENTS

| | | | |
|---|---|---|---|
| CN | 206713020 | U | 12/2017 |
| EP | 2360943 | A1 | 8/2011 |
| EP | 3253035 | A1 | 12/2017 |
| JP | 2011-061422 | A | 3/2011 |
| JP | 2015-070514 | A | 4/2015 |
| JP | 2015-156699 | A | 8/2015 |
| JP | 2017-125937 | A | 7/2017 |
| WO | WO-2009153718 | A1 | 12/2009 |
| WO | 2017/058590 | A1 | 4/2017 |
| WO | WO-2017222222 | A1 | 12/2017 |

* cited by examiner

EARPHONE, EARPHONE SYSTEM, AND METHOD IN EARPHONE SYSTEM

CROSS-REFERENCE TO RELATED APPLICATIONS

The present application is based on PCT filing PCT/JP2019/004474, filed Feb. 7, 2019, which claims priority to JP 2018-030327, filed Feb. 23, 2018, the entire contents of each are incorporated herein by reference.

TECHNICAL FIELD

The present disclosure relates to an earphone, an earphone system, and a method in an earphone system.

BACKGROUND ART

Conventionally, for example, Patent Document 1 below discloses an information processing apparatus including two microphones for collecting outside sound and converting the sound into sound signals, and a sound signal processing unit that applies processing including beamforming processing to the sound signals input from the microphones.

CITATION LIST

Patent Document

Patent Document 1: Japanese Patent Application Laid-Open No. 2011-61422

SUMMARY OF THE INVENTION

Problems to be Solved by the Invention

In a case where an earphone includes a microphone and transmits sound acquired by the microphone to the outside, the sound quality can be further improved as the number of microphones increases. However, when the number of microphones is increased, forming an effective microphone array while maintaining a small size of the earphone is difficult. It is difficult to mount a plurality of microphones on one of a pair of ear heads particularly in the ear heads highly demanded for a decrease in size. Patent Document 1 describes application of beamforming processing to the sound signals input from the two microphones, but wirelessly collecting the sound signals and applying the beamforming processing has not been assumed.

Therefore, further improvement of the quality of sound obtained by an earphone has been desired.

Solutions to Problems

According to the present disclosure, provided is an earphone that is one of earphones configuring an ear headset, the earphone including a sound acquisition unit configured to acquire sound data, a communication unit configured to receive sound data from the other earphone by wireless communication, and a sound quality improvement processing unit configured to perform processing of improving sound quality of the sound data acquired by the sound acquisition unit and the sound data received from the other earphone.

According to the present disclosure, provided is an earphone that is one of earphones configuring an ear headset, the earphone including a sound acquisition unit configured to acquire sound data, and a communication unit configured to transmit the sound data acquired by the sound acquisition unit to the other earphone by wireless communication in order to perform processing of improving sound quality of sound data acquired by the other earphone and the sound data acquired by the sound acquisition unit.

According to the present disclosure, provided is an earphone system including a first earphone that is one of earphones configuring an ear headset, the first earphone including a sound acquisition unit configured to acquire sound data, a communication unit configured to receive sound data from the other earphone by wireless communication, and a sound quality improvement processing unit configured to perform processing of improving sound quality of the sound data acquired by the sound acquisition unit and the sound data received from the other earphone, and a second earphone that is the other of the earphones configuring the ear headset, the second earphone including a sound acquisition unit configured to acquire sound data, and a communication unit configured to transmit the sound data acquired by the sound acquisition unit to the other earphone.

Furthermore, according to the present disclosure, provided is a method in an earphone system, the method including acquiring sound data by one earphone configuring an ear headset, acquiring sound data by the other earphone configuring the ear headset, receiving, by the one earphone, by wireless communication, the sound data acquired by the other earphone, and performing processing of improving sound quality of the sound data acquired by the one earphone and the sound data received from the other earphone.

Effects of the Invention

As described above, according to the present disclosure, the quality of sound acquired by an earphone can be further improved.

Note that the above-described effect is not necessarily limited, and any of effects described in the present specification or another effect that can be grasped from the present specification may be exerted in addition to or in place of the above-described effect.

MODE FOR CARRYING OUT THE INVENTION

Figure 1:
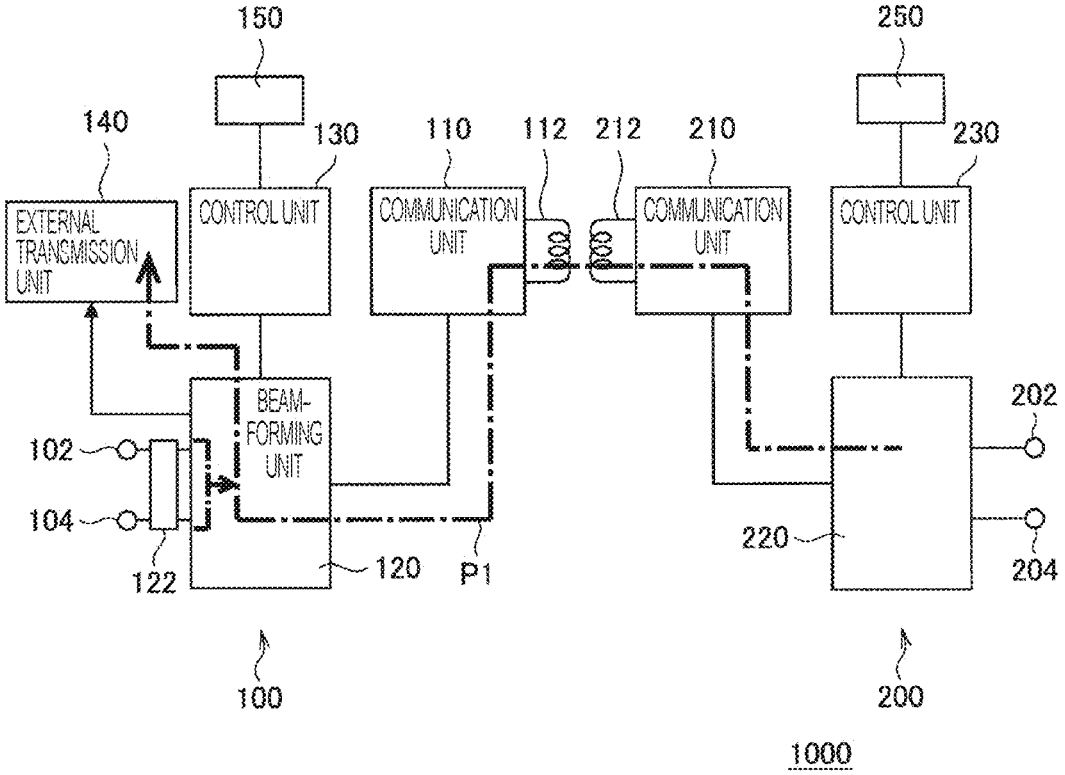
FIG. 1 is a schematic diagram illustrating a configuration of an earphone system according to an embodiment of the present disclosure.

Favorable embodiments of the present disclosure will be described in detail below with reference to the accompanying drawings. Note that, in the present specification and the drawings, redundant description of constituent elements having substantially the same functional configurations is omitted by giving the same reference numerals.

Note that the description will be given in the following order.

1. System Configuration Example
2. Case of Using Audio Channel
3. Case of Using Data Channel
1. System Configuration Example First, a configuration of an earphone system 1000 according to an embodiment of the present disclosure will be described with reference to FIG. 1. As illustrated in FIG. 1, the system 1000 includes an ear headset including a master-side earphone 100 and a slave-side earphone 200. The master-side earphone 100 and the slave-side earphone 200 are separately configured and are inserted into respective ears of a user. As an example, it is assumed that the master-side earphone 100 is inserted into the right ear, and the slave-side earphone 200 is inserted into the left ear.

The master-side earphone 100 includes two microphones 102 and 104. Furthermore, the master-side earphone 100 includes a communication unit 110, an antenna 112, a beamforming unit (sound quality improvement processing unit) 120, a delay unit 122, a control unit 130, an external transmission unit 140, and a power supply IC 150.

Similarly, the slave-side earphone 200 includes two microphones 202 and 204. Furthermore, the slave-side earphone 200 includes a communication unit 210, an antenna 212, an audio codec unit 220, a control unit 230, and a power supply IC 250.

In the system 1000 according to the present embodiment, sound acquired by the microphones 102 and 104 of the master-side earphone 100 and sound acquired by the microphones 202 and 204 of the slave-side earphone 200 are beamformed on the master side, and sound information is transmitted to an automatic speech recognition (ASR) engine or the like. At this time, high quality sound information with a high S/N ratio can be obtained as the number of microphones is larger. Therefore, according to the system 1000 of the present embodiment, beamforming can be performed using the sound of the four microphones 102, 104, 202, and 204. Therefore, high quality sound with reduced noise can be obtained, and a success rate of sound recognition in the automatic speech recognition engine or the like can be increased, as compared with a case where beamforming is performed at each of the master-side earphone 100 and the slave-side earphone 200. Furthermore, a total of four microphones can be dispersedly arranged in the master-side earphone 100 and the slave-side earphone 200. Therefore, the earphones can be decreased in size as compared with a case where all the microphones are arranged in either the master-side earphone 100 or the slave-side earphone 200.

Furthermore, the beamformed sound may be transmitted to an ear headset used by another person to make a voice call with the another person. Even in this case, a high quality voice call can be made.

The beamforming is performed by the beamforming unit 120 of the master-side earphone 100. Therefore, the sound acquired by the microphones 202 and 204 of the slave-side earphone 200 is transmitted to the master-side earphone 100. Although various methods can be used as a transmission method, the system 1000 of the present embodiment sends the sound from the slave-side earphone 200 to the master-side earphone 100 using especially near field magnetic induction (NFMI) via the antennas 112 and 212. Thus, the master-side earphone 100 can perform beamforming using the sound of the four microphones 102, 104, 202, and 204.

Note that, in the present embodiment, beamforming processing of causing a sound to have directionality is illustrated as processing of improving the quality of sound acquired by the plurality of microphones 102, 104, 202, and 204. However, sound quality improvement processing other than the beamforming processing may be performed. For example, processing of reducing wind noise of the sound acquired by the plurality of microphones 102, 104, 202, and 204 or the like may be performed. Therefore, the beamforming unit 120 functions as a sound quality improvement processing unit in a broad sense.

When transmitting sound from the slave-side earphone 200 to the master-side earphone 100 using NFMI, an audio channel and a data channel can be used. Note that the audio channel is a wireless transmission path in which data arrival delay time is constant because data integrity is not guaranteed. Furthermore, the data channel is a wireless transmission path in which data integrity is guaranteed. In the data channel, information transmission time is affected by error correction or the like. In the present embodiment, the sound is transmitted from the slave-side earphone 200 to the master-side earphone 100 using the audio channel or the data channel. Hereinafter, the case where the audio channel is used and the case where the data channel is used will be respectively described.

2. Case of Using Audio Channel

First, the case of transmitting the sound from the slave-side earphone 200 to the master-side earphone 100 using the audio channel will be described on the basis of FIG. 1. The microphones 202 and 204 of the slave-side earphone 200 acquire sound as pulse code modulation (PCM) data. The sound acquired by the microphones 202 and 204 of the slave-side earphone 200 is sent from the communication unit 210 of the slave-side earphone 200 to the communication unit 110 of the master-side earphone 100 using NFMI.

In the case of using the audio channel, the communication unit 210 and the communication unit 110 automatically compress and decompress sound data using an irreversible audio codec. As the irreversible audio codec, an audio codec such as ADPCM is used, for example. The communication unit 210 compresses the PCM data, and the communication unit 110 converts the compressed data into the PCM by decompression. Therefore, reversible compression and decompression of sound data is not performed by the control unit 230 and the control unit 130, unlike the case of using the data channel to be described below. In the case of using the irreversible audio codec such as ADPCM, the sound quality may be slightly deteriorated.

In the master-side earphone 100, the sound of the slave-side microphones 202 and 204 is sent from the communication unit 110 to the beamforming unit 120. Meanwhile, the sound acquired by the microphones 102 and 104 of the master-side earphone 100 is also sent to the beamforming unit 120. The sound acquired by the microphones 102 and 104 of the master-side earphone 100 is delayed by the delay unit 122 by a predetermined time. Thereby, beamforming can be optimally performed in consideration of a delay that occurs when the sound is transmitted from the slave-side earphone 200 to the master-side earphone 100.

The beamforming unit 120 performs beamforming of four channels using the sound of the four microphones 102, 104, 202, and 204. The beamformed sound is sent to the external transmission unit 140. The external transmission unit 140 transmits the beamformed sound to an external device, using a method such as Bluetooth (registered trademark), for example. Furthermore, the earphone system 1000 can be directly connected to a network such as the Internet. In this case, the sound is directly transmitted from the external transmission unit 140 to an application such as an automatic speech recognition engine without passing through an external device.

As described above, in the case of using the audio channel, the sound data is sent along the one-dot chain line P1 illustrated in FIG. 1. Note that the control unit 130 has a function to control all the configuration elements of the master-side earphone 100. Similarly, the control unit 230 has a function to control all the configuration elements of the slave-side earphone 200.

The external device is, for example, a device such as a smartphone or a personal computer (PC). When the external device receives the sound from the external transmission unit 140, the sound is input to an application such as an automatic speech recognition engine, for example, and sound recognition is performed. Thereby, a search engine searches for desired information.

3. Case of Using Data Channel

Next, the case of transmitting the sound from the slave-side earphone 200 to the master-side earphone 100 using the data channel will be described on the basis of FIG. 2. Similarly to the case of using the audio channel, the microphones 202 and 204 of the slave-side earphone 200 acquire sound as PCM data. The sound acquired by the microphones 202 and 204 of the slave-side earphone 200 is sent to the control unit 230. The control unit 230 encodes the sound and sends encoded sound data to the communication unit 210. Then, the encoded sound data is sent from the communication unit 210 of the slave-side earphone 200 to the communication unit 110 of the master-side earphone 100 using NFMI.

The communication unit 110 of the master-side earphone 100 receives the encoded sound data and sends the encoded sound data to the control unit 130. The control unit 130 decodes the encoded sound data and sends the decoded sound data to the beamforming unit 120.

In the case of using the data channel, the encoding processing performed by the slave-side earphone 200 is reversible compression, and the master-side earphone 100 performs the decoding processing, and thus the master-side earphone 100 can restore the sound in an original sound state. Therefore, when the sound is sent from the slave-side earphone 200 to the master-side earphone, the sound quality is not deteriorated, and the sound can maintain the high quality original sound. Note that FLAC or the like can be used as a codec method, for example.

The beamforming unit 120 performs beamforming using the sound of the four microphones 102, 104, 202, and 204. Subsequent steps are similar to the steps in the case of using the audio channel. The beamformed sound is sent to the external transmission unit 140. The external transmission unit 140 transmits the beamformed sound to an external device, using a method such as Bluetooth (registered trademark), for example.

Figure 2:
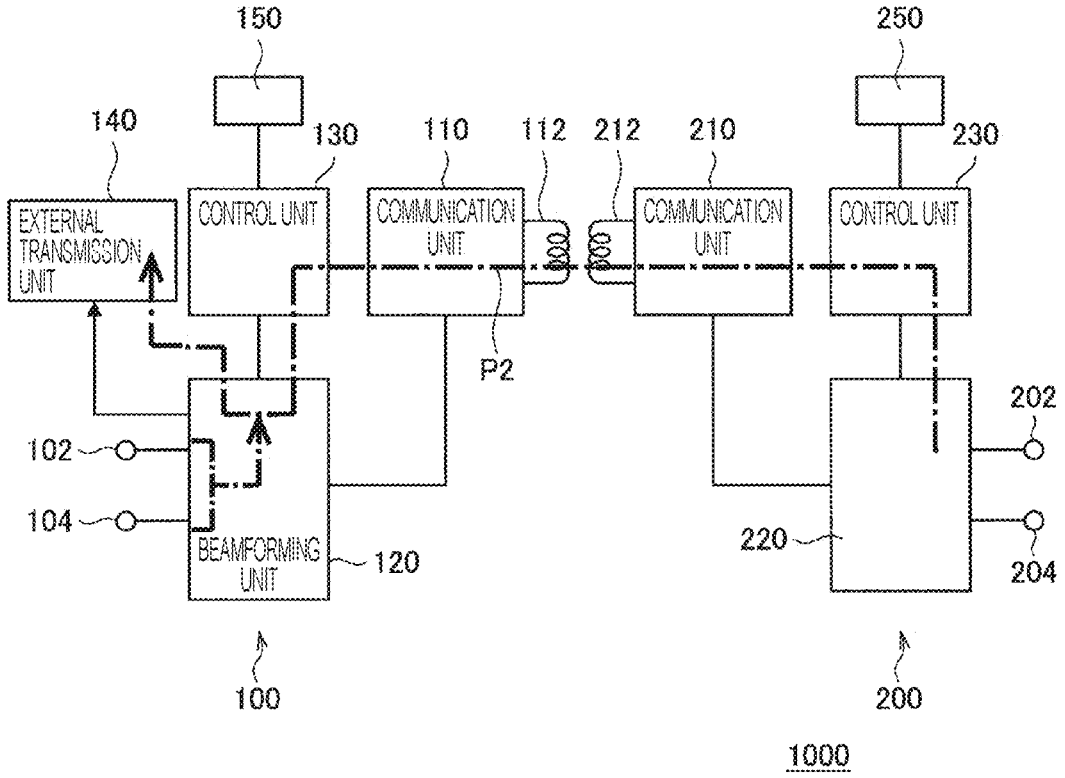
FIG. 2 is a schematic diagram illustrating a case of transmitting sound from a slave-side earphone to a master-side earphone using a data channel.

As described above, in the case of using the data channel, the sound data is sent along the one-dot chain line P2 illustrated in FIG. 2. Note that the control unit 130 has a function to control all the configuration elements of the master-side earphone 100, in addition to performing the above-described decoding processing. Similarly, the control unit 230 controls all the configuration elements of the slave-side earphone 200, in addition to performing the above-described encoding processing.

In the case of using the data channel, the microphones 202 and 204 of the slave-side earphone 200 and the microphones 102 and 104 of the master-side earphone 100 acquire sound at the same time.

Therefore, a timing signal indicating timing to start sound acquisition is sent from the master-side earphone 100 to the slave-side earphone 200 using the audio channel. A timing signal is sent using the audio channel. The slave-side earphone 200 starts sound acquisition at the time when receiving the timing signal. Since a delay time between the master and slave is a fixed value, the master-side earphone 100 starts sound acquisition after waiting for the delay time that is the fixed value. Thereby, the microphones 202 and 204 of the slave-side earphone 200 and the microphones 102 and 104 of the master-side earphone 100 can acquire sound at the same time.

Figure 3:
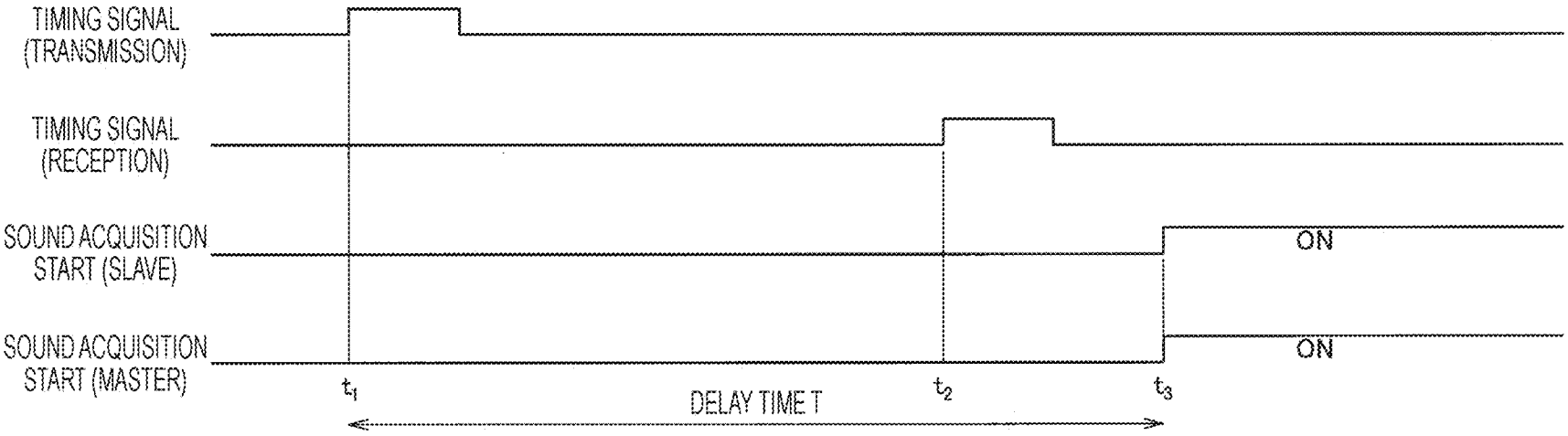
FIG. 3 is a timing chart for describing delay processing performed by the master-side earphone.

FIG. 3 is a timing chart for describing delay processing performed by the master-side earphone 100. FIG. 3 illustrates, from the top, the timing signal transmitted by the master-side earphone 100 to the slave-side earphone 200, the timing signal received by the slave-side earphone 200, and the timing signal at which the master-side earphone 100 starts sound acquisition.

As illustrated in FIG. 3, when the master-side earphone 100 transmits the timing signal to the slave-side earphone 200 at time t1, the slave-side earphone 200 receives the timing signal at time t2. When the slave-side earphone 200 receives the timing signal at time t2, the slave-side earphone 200 starts sound acquisition at time t3 at which a predetermined time has elapsed. Note that the time from time t2 to time t3 is a time arising from a response time of hardware, and is a fixed value.

When a predetermined delay time T has elapsed after transmitting the timing signal at time t1, the master-side earphone 100 starts sound acquisition. The delay time T is determined in advance such that the timing at which the master-side earphone 100 acquires sound coincides with the time t3. Thereby, the timing of acquiring sound can be made coincide with each other between the master-side earphone 100 and the slave-side earphone 200. Thereby, the sound from the slave-side earphone 200 to the master-side earphone 100 can be synchronized, and the master-side beamforming unit 120 can optimally perform beamforming.

Note that, for example, the sound acquisition (recording) by the microphones 102, 104, 202, and 204 is performed for every fixed time (for every 20 ms, for example), and the sound data is beamformed and sent to the external transmission unit 140. A transfer delay from the slave-side earphone 200 to the master-side earphone 100 is not a problem if after the sound data is sent to the external transmission unit 140, the sound data is transferred from the slave-side earphone 200 to the master-side earphone 100 and the beamforming processing is completed during the next fixed time.

Note that, in the case of the audio channel, the delay time of the audio channel is a predetermined value, and thus the beamforming unit 120 of the master-side earphone 100 can perform beamforming in consideration of the delay time. Therefore, transmission of a timing signal from the master-side earphone 100 to the slave-side earphone 200 is not necessary.

Note that, in the present embodiment, the description has been made using the earphone system 1000 including an ear headset including one master-side earphone 100 and one slave-side earphone 200 as an example. However, there may be a plurality of the slave-side earphones 200, for example. Thereby, the number of microphones can be increased, and further improvement of the sound quality can be achieved.

As described above, according to the present embodiment, the sound acquired by the microphones 102 and 104 of the master-side earphone 100 and sound acquired by the microphones 202 and 204 of the slave-side earphone 200 are collected and beamformed on the master side. Therefore, the quality of the beamformed sound can be improved. Furthermore, since the plurality microphones can be dispersedly arranged on the master side and the slave side, downsizing of the master-side earphone 100 and the slave-side earphone 200 can be achieved.

Although the favorable embodiment of the present disclosure has been described in detail with reference to the accompanying drawings, the technical scope of the present disclosure is not limited to such examples. It is obvious that persons having ordinary knowledge in the technical field of the present disclosure can conceive various changes and alterations within the scope of the technical idea described in the claims, and it is naturally understood that these changes and alterations belong to the technical scope of the present disclosure.

Furthermore, the effects described in the present specification are merely illustrative or exemplary and are not restrictive. That is, the technology according to the present disclosure can exhibit other effects obvious to those skilled in the art from the description of the present specification together with or in place of the above-described effects.

Note that following configurations also belong to the technical scope of the present disclosure.

(1) An earphone that is one of earphones configuring an ear headset, the earphone including:

a sound acquisition unit configured to acquire sound data;

a communication unit configured to receive sound data from the other earphone by wireless communication; and a sound quality improvement processing unit configured to perform processing of improving sound quality of the sound data acquired by the sound acquisition unit and the sound data received from the other earphone.

(2) The earphone according to (1), in which the communication unit receives the sound data from the other earphone by short-range magnetic induction.

(3) The earphone according to (2), in which the communication unit receives the sound data from the other earphone using an audio channel.

(4) The earphone according to (3), further including: a delay unit configured to delay the sound data acquired by the sound acquisition unit with respect to the sound data received from the other earphone.

(5) The earphone according to (2), in which the communication unit receives the sound data from the other earphone using a data channel.

(6) The earphone according to (5), in which the earphone transmits a timing signal indicating timing that the other earphone starts acquisition of the sound data, and the sound acquisition unit starts acquisition of the sound data after an elapse of a predetermined delay time from the transmission of the timing signal.

(7) The earphone according to (5), in which the sound data received from the other earphone has been encoded, and the earphone further includes a decoding unit configured to decode the sound data received from the other earphone.

(8) An earphone that is one of earphones configuring an ear headset, the earphone including:

a sound acquisition unit configured to acquire sound data; and a communication unit configured to transmit the sound data acquired by the sound acquisition unit to the other earphone by wireless communication in order to perform processing of improving sound quality of sound data acquired by the other earphone and the sound data acquired by the sound acquisition unit.

(9) The earphone according to (8), in which the communication unit transmits the sound data acquired by the sound acquisition unit by short-range magnetic induction.

(10) The earphone according to (9), in which the communication unit transmits the sound data acquired by the sound acquisition unit using an audio channel.

(11) The earphone according to (9), in which the communication unit transmits the sound data acquired by the sound acquisition unit using a data channel.

(12) The earphone according to (11), in which a timing signal indicating timing to start acquisition of the sound data from the other earphone, and the sound acquisition unit starts acquisition of the sound data when receiving the timing signal.

(13) The earphone according to (11) or (12), further including:

an encoding unit configured to encode the sound data acquired by the sound acquisition unit, in which the communication unit transmits the encoded sound data.

(14) An earphone system including:

a first earphone that is one of earphones configuring an ear headset, the first earphone including a sound acquisition unit configured to acquire sound data, a communication unit configured to receive sound data from the other earphone by wireless communication, and a sound quality improvement processing unit configured to perform processing of improving sound quality of the sound data acquired by the sound acquisition unit and the sound data received from the other earphone; and a second earphone that is the other of the earphones configuring the ear headset, the second earphone including a sound acquisition unit configured to acquire sound data, and a communication unit configured to transmit the sound data acquired by the sound acquisition unit to the other earphone.

(15) A method in an earphone system, the method including:

acquiring sound data by one earphone configuring an ear headset;

acquiring sound data by the other earphone configuring the ear headset;

receiving, by the one earphone, by wireless communication, the sound data acquired by the other earphone; and performing processing of improving sound quality of the sound data acquired by the one earphone and the sound data received from the other earphone.

REFERENCE SIGNS LIST

100, 200 Earphone
110, 210 Communication unit
120 Beamforming unit
122 Delay unit
1000 Earphone system

The invention claimed is:

1. An earphone that is one of two or more earphones configuring an ear headset, the earphone comprising:

a plurality of microphones configured to acquire sound data; and circuitry configured to receive sound data from at least one other earphone of the two or more earphones by wireless communication; and perform processing of improving sound quality of the acquired sound data and the sound data received from the at least one other earphone, wherein the earphone transmits a timing signal indicating timing that the at least one other earphone starts acquisition of the sound data, and wherein the plurality of microphones starts acquisition of the sound data after an elapse of a predetermined delay time from the transmission of the timing signal.

2. The earphone according to claim 1, wherein the circuitry receives the sound data from the other earphone by short-range magnetic induction.

3. The earphone according to claim 2, wherein the circuitry receives the sound data from the other earphone using an audio channel.

4. The earphone according to claim 3, wherein the circuitry is further configured to delay the acquired sound data with respect to the sound data received from the other earphone.

5. The earphone according to claim 2, wherein circuitry receives the sound data from the other earphone using a data channel.

6. The earphone according to claim 5, wherein the sound data received from the other earphone has been encoded, and the earphone further includes a decoding unit configured to decode the sound data received from the other earphone.

7. An earphone that is one of earphones configuring an ear headset, the earphone comprising:

a plurality of microphones configured to acquire sound data; and circuitry configured to transmit the sound data to the other earphone by wireless communication in order to perform processing of improving sound quality of sound data acquired by the other earphone and the acquired sound data, wherein the earphone receives a timing signal indicating timing to start acquisition of the sound data from the other earphone, and wherein the earphone starts acquisition of the sound data when receiving the timing signal.

8. The earphone according to claim 7, wherein the circuitry transmits the sound data acquired by the sound acquisition unit by short-range magnetic induction.

9. The earphone according to claim 8, wherein the circuitry transmits the acquired sound data using an audio channel.

10. The earphone according to claim 8, wherein the circuitry transmits the acquired sound data using a data channel.

11. The earphone according to claim 10, further comprising:

an encoding unit configured to encode the sound data acquired by the sound acquisition unit, wherein the circuitry transmits the encoded sound data.

12. An earphone system comprising:

a first earphone that is one of earphones configuring an ear headset, the first earphone including a plurality of microphones configured to acquire sound data, a receive sound data from another earphone by wireless communication, and perform processing of improving sound quality of the acquired sound data and the sound data received from the other earphone; and a second earphone that is the other of the earphones configuring the ear headset, the second earphone including another plurality of microphones configured to acquire sound data, and transmit the acquired sound data to the other earphone, wherein the first earphone transmits a timing signal indicating timing that the second earphone starts acquisition of the sound data, and wherein the plurality of microphones in the first earphone starts acquisition of the sound data after an elapse of a predetermined delay time from the transmission of the timing signal.

13. A method in an earphone system, the method comprising:

acquiring sound data by one earphone that is one of earphones configuring an ear headset;

acquiring sound data by another earphone that is the other of the earphones configuring the ear headset;

receiving, by the one earphone, by wireless communication, the sound data acquired by the other earphone; and performing processing of improving sound quality of the sound data acquired by the one earphone and the sound data received from the other earphone, wherein the one earphone transmits a timing signal indicating timing that the other earphone starts acquisition of the sound data, and wherein the one earphone starts acquisition of the sound data after an elapse of a predetermined delay time from the transmission of the timing signal.

* * * * *